US009277793B2

(12) United States Patent
Rana et al.

(10) Patent No.: US 9,277,793 B2
(45) Date of Patent: Mar. 8, 2016

(54) USER CONFIGURABLE WEARABLE DEVICE

(71) Applicant: Pleying Inc., San Jose, CA (US)

(72) Inventors: Amit Singh Rana, Campbell, CA (US); Jacob Wingrove Lafleur, San Jose, CA (US); Ranan Lachman, Los Gatos, CA (US)

(73) Assignee: PLEYING INC., San Jose, CA (US)

( * ) Notice: Subject to any disclaimer, the term of this patent is extended or adjusted under 35 U.S.C. 154(b) by 99 days.

(21) Appl. No.: 14/259,073

(22) Filed: Apr. 22, 2014

(65) Prior Publication Data

US 2015/0296935 A1 Oct. 22, 2015

(51) Int. Cl.

| | |
|---|---|
| ***A44C 15/00*** | (2006.01) |
| ***A44C 17/02*** | (2006.01) |
| ***A44C 5/00*** | (2006.01) |

(52) U.S. Cl.

CPC ..... *A44C 17/0208* (2013.01); *A44C 5/0007* (2013.01); *A44C 5/0053* (2013.01)

(58) Field of Classification Search

None

See application file for complete search history.

(56) References Cited

U.S. PATENT DOCUMENTS 8,540,544 B1 * 9/2013 Logue ..... A44C 5/00 446/101

* cited by examiner

*Primary Examiner* — Jack W Lavinder

(74) *Attorney, Agent, or Firm* — Alston & Bird LLP

(57) ABSTRACT

User configurable wearable devices are discussed herein. Some embodiments may include a wearable device including a flexible band having an outer surface. The flexible band may be formed into a loop and worn on a user or an object. A plurality of male interface components may be disposed on the outer surface. Each male interface component may comprise a protrusion dimensioned to be capable of insertion within a female interface component of an object, such as a building block, to mechanically attach the object with the flexible band. In some embodiments, each of the male interface components may be separated from each other by at least a common or standard distance, such as the distance defined between two adjacent female interface components of the object. Furthermore, adjacent male interface components may be separated by the standard distance for interfacing with adjacent female interface components of an object.

18 Claims, 5 Drawing Sheets

USER CONFIGURABLE WEARABLE DEVICE

FIELD

Embodiments of the invention relate, generally, to wearable devices that can be configured by a user.

BACKGROUND

The clothing and accessories, or wearable devices, worn by an individual can communicate aspects of the individual's interests, beliefs, hobbies, ideals, and personality. For example, the color, text engravings, or other characteristics of a bracelet can communicate a support for a particular social or charitable cause. In another example, a belt may include a graphical design or a sculptural work that expresses the individual's preference for a certain media (e.g., movies, music, games, literary works, etc.). In yet another example, a bracelet may include functional features such as a clock or electronic device. The various functional and aesthetic features of wearable devices are designed to broadly appeal to various segments of consumers, thereby allowing little opportunity for individual creativity and self-expression. In this regard, areas for improving current techniques have been identified.

BRIEF SUMMARY

Through applied effort, ingenuity, and innovation, solutions to improve wearable devices have been realized and are described herein. For example some embodiments may provide for a wearable device including a flexible band (and/or other flexible material) and a plurality of male interface components disposed on the outer surface of the flexible band. Each of the plurality of male interface components may comprise a protrusion from the outer surface of the flexible band that is dimensioned to be capable of insertion within a female interface component of an object to mechanically attach the object with the flexible band. In some embodiments, the object may be a building block that can include one or more female interface components. As such, various objects may be mechanically attached with the wearable device via interfacing some or all of the one or more female interface components of the object with a respective male interface component of the wearable device. Furthermore, the object may include male interface components or female interface components in addition to those used for attachment to the wearable device. These additional interface components may include at least one male interface component and/or female interface component that can be used to attach other objects. As such, an individual could design or configure the wearable device as desired.

In some embodiments, the plurality of male interface components may have a common shape and size. For example, the plurality of male interface components may include a circular cross sectional shape having a diameter of substantially 5 millimeters.

In some embodiments, the plurality of interface components are separated from each other by at least a distance defined between two adjacent female interface components of the object. For example, the distance may be substantially 3.1 millimeters.

In some embodiments, the plurality of male interface components may include at least three male interface components arranged in a row and separated from each other by a common distance along the row.

In some embodiments, the plurality of male interface components may include a first row of male interface components and a second row of male interface components aligned in parallel to the first row of male interface components; each of the first row of male interface components may be separated from each other by a common distance; each of the second row of male interface components may be separated from each other by the common distance; and each of the first row of male interface components may be separated from a respective one of the second row of male interface components by the common distance.

In some embodiments, the wearable device may further include a band connection component configured to connect a first end portion of the flexible band with a second end portion of the flexible band.

In some embodiments, the wearable device may further include an object. The object may include one or more male interface components. Each of the one or more male interface components of the object may comprise a protrusion having a height that is less than a height of the plurality of male interface components of the wearable device. In some embodiments, the height of the plurality of male interface components of the wearable device is greater than 1.6 millimeters. In some embodiments, the object may be a building block.

In some embodiments, the wearable device may further include at least one female interface component disposed on the outer surface of the flexible band. In some embodiments, the female interface component may be separated from each of the plurality of male interface components by at least a distance defined between two adjacent female and/or male interface components of the object.

In some embodiments, the wearable device may include a power supply including a positive terminal and a negative terminal. A first of the plurality of male interface components may include a first conductive contact connected with the positive terminal and a second of the plurality of male interface components may include a second conductive contact connected with the negative terminal.

These characteristics as well as additional features, functions, and details of various embodiments are described below. Similarly, corresponding and additional embodiments are also described below.

BRIEF DESCRIPTION OF THE DRAWINGS

Figure 1:
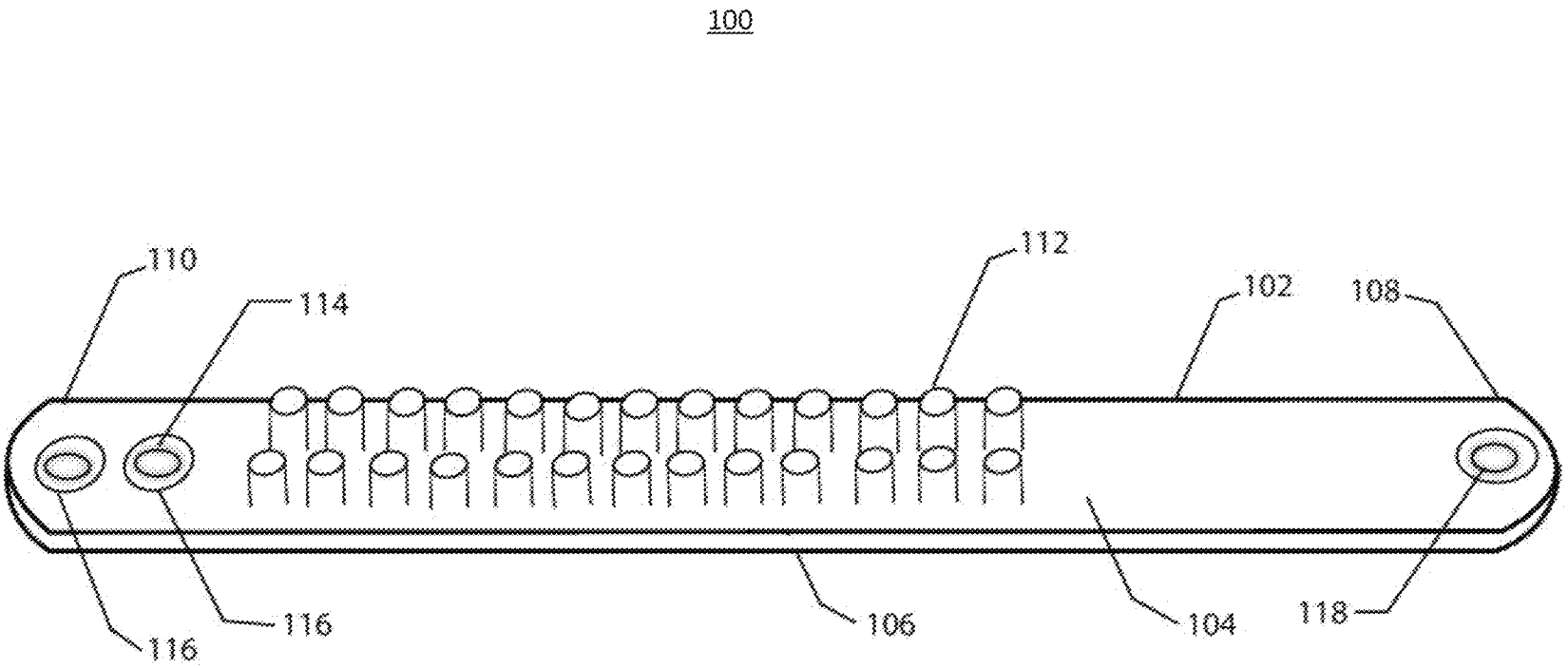
Figure 2:
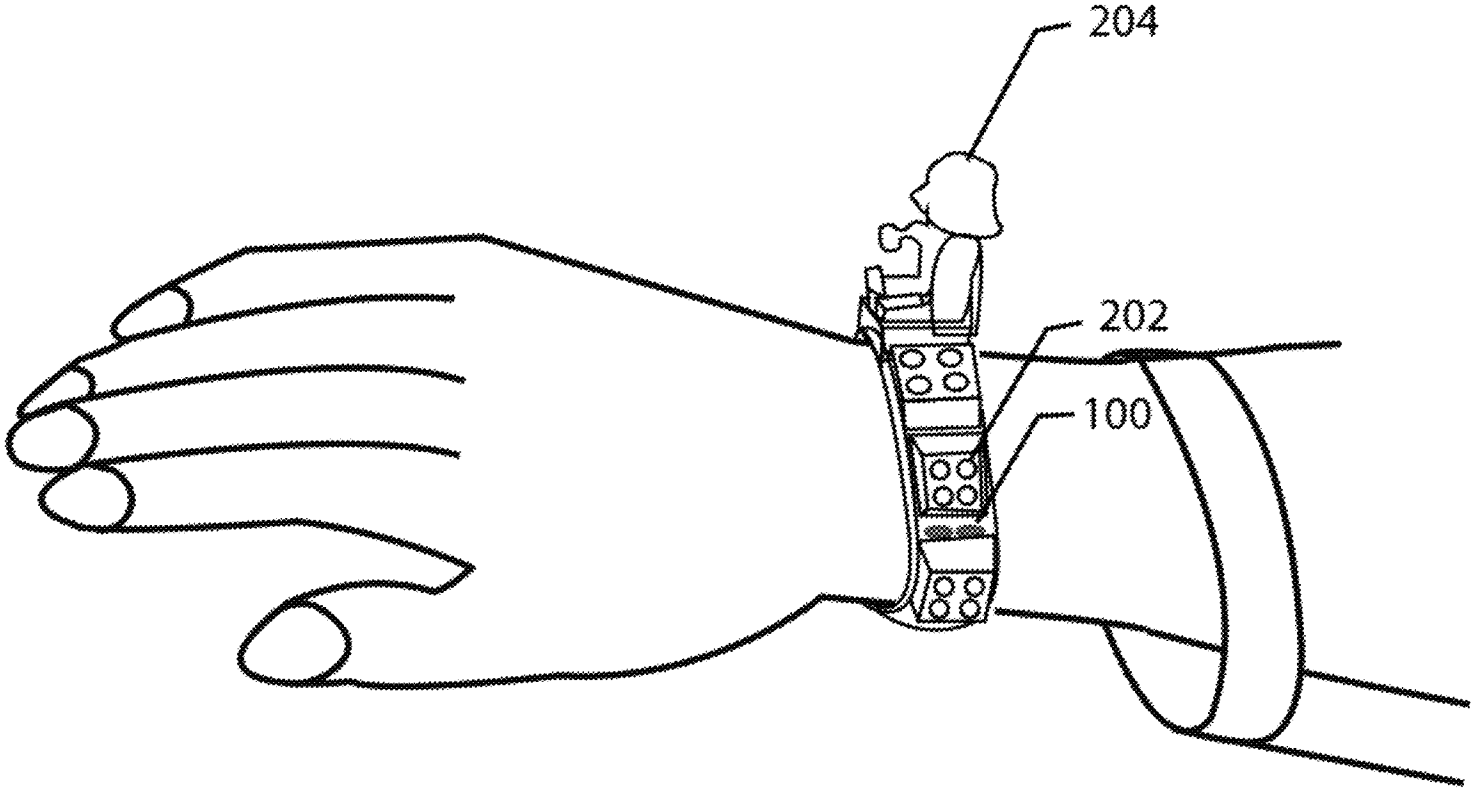
Figure 3:
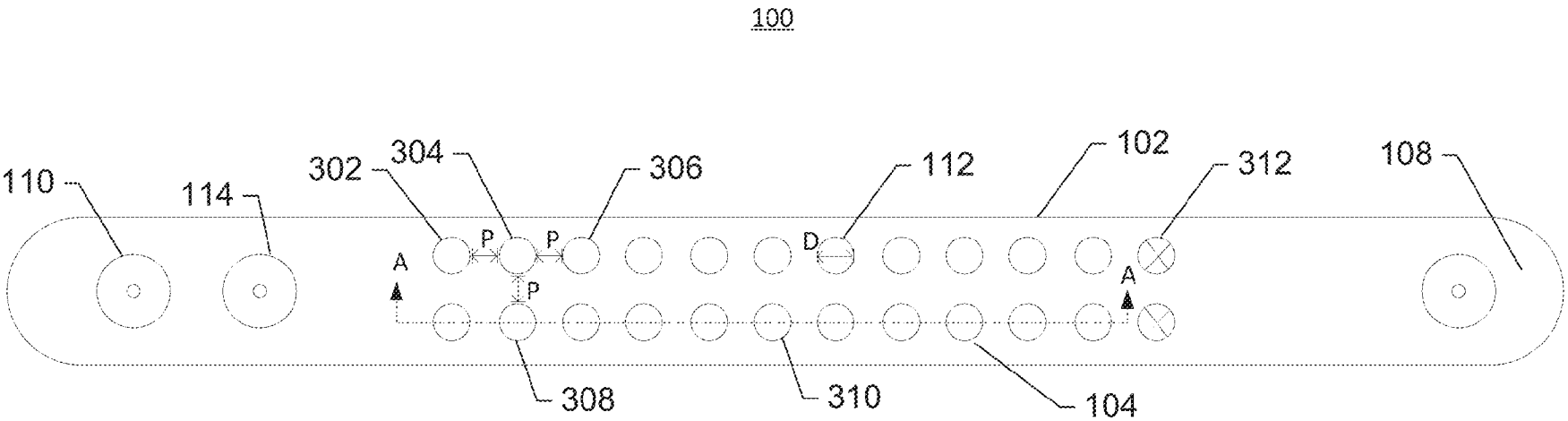
Figure 4:
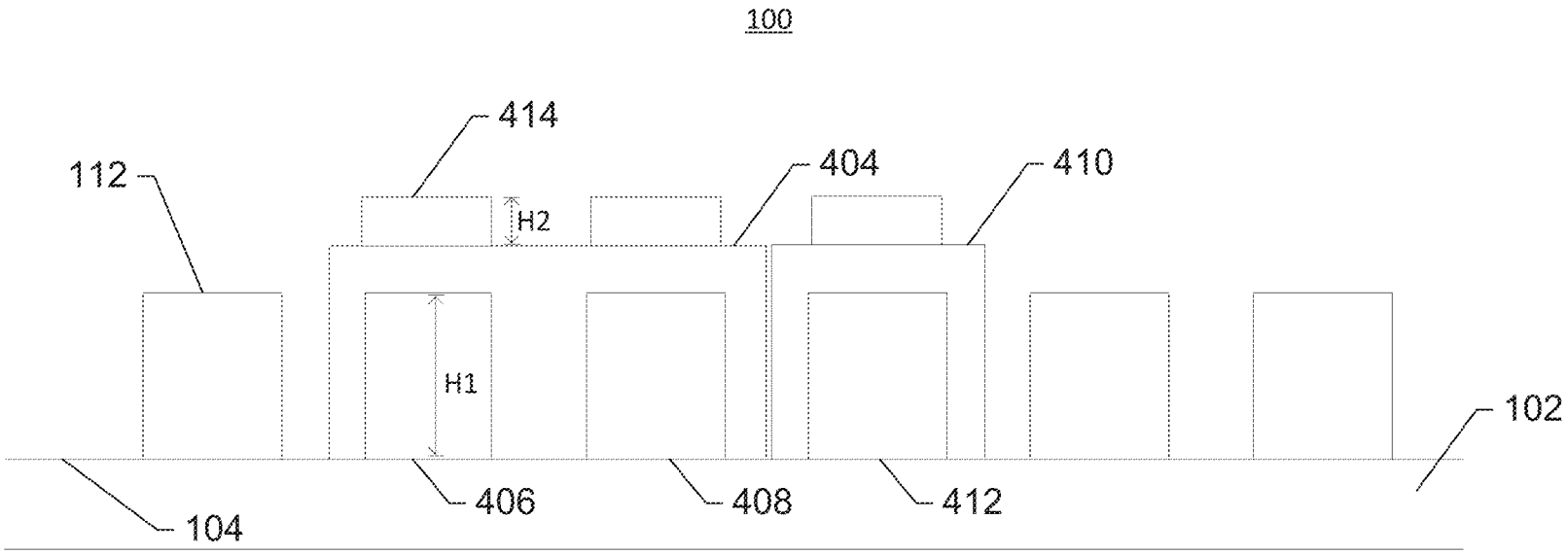
Figure 5:
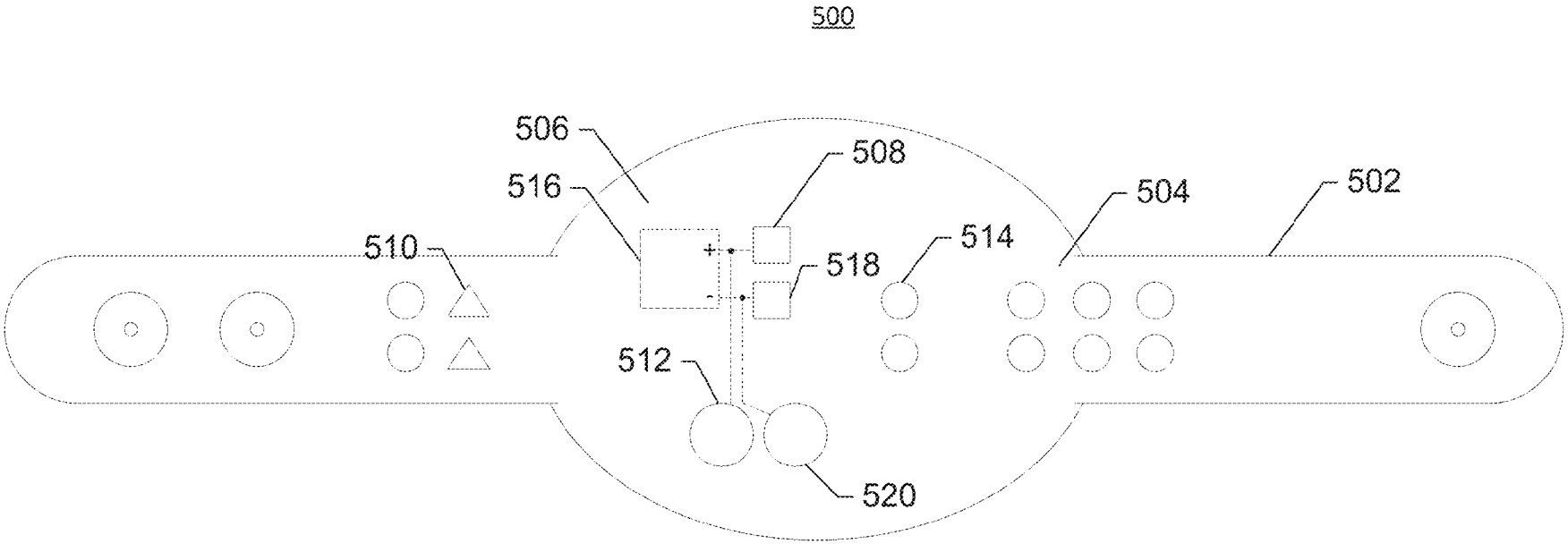

Having thus described some embodiments in general terms, reference will now be made to the accompanying drawings, which are not necessarily drawn to scale, and wherein:

FIG. 1 shows a perspective view of an example of a wearable device in accordance with some embodiments;

FIG. 2 shows a perspective view of an example of a wearable device on a user's wrist and including attached objects in accordance with some embodiments;

FIG. 3 shows a top view of an example of a wearable device in accordance with some embodiments;

FIG. 4 shows a cross sectional view of an example of a wearable device in accordance with some embodiments; and FIG. 5 shows a top view of an example of a wearable device in accordance with some embodiments.

DETAILED DESCRIPTION

Embodiments will be described more fully hereinafter with reference to the accompanying drawings, in which some, but not all embodiments contemplated herein are shown. Indeed, various embodiments may be implemented in many different forms and should not be construed as limited to the embodiments set forth herein; rather, these embodiments are provided so that this disclosure will satisfy applicable legal requirements. Like numbers refer to like elements throughout.

FIGS. 1-4 show various views of an example of a wearable device 100 in accordance with some embodiments. With reference to FIG. 1, showing a perspective view, wearable device 100 may include flexible band 102 and one or more male interface components 112. Flexible band 102 may define or include outer surface 104, inner surface 106, end portion 108, end portion 110, and one or more band connection components 114.

As shown in the perspective view of FIG. 2, wearable device 100 may be worn on an individual's body, such as on the wrist. Returning to FIG. 1, flexible band 102 may be configured to be capable of being formed into a loop such that flexible band 102 can be worn on the individual, such as on the individual's wrist, arm, leg, torso, or any other object on the body or external to the body. When formed into a loop, inner surface 106 may be the surface of flexible band 102 nearest to the individual's body at witch wearable device 100 is worn. Outer surface 104 may be defined as the surface that is opposite to inner surface 106. As such, the outer surface 104 and/or interface components disposed on outer surface 104 may be visible, accessible, and/or exposed when wearable device 100 is worn on the individual.

In some embodiments, end portions 108 and 110 of flexible band 102 may be configured to be connectable with each other. Flexible band 102 may include one or more band connection components 114 configured to connect end portion 108 with end portion 110. For example, connection components 114 may include one or more first type connection components 116 disposed at end portion 110 and a second type connection component 118 disposed at end portion 112. Second type connection component 118 may be configured to mechanically attach with a first type connection component 116. In some embodiments, flexible band 102 may include a plurality of first type connection components 116. The plurality of first type connection components 116 may be disposed along a length of flexible band 102 running from end portion 108 to end portion 110 such that flexible band 102 can be formed into loops of different sizes based on interfacing second type connection component 118 with the suitable first type connection component 116. In that sense, flexible band 102 may fit to individuals of different size and/or different parts of the body.

In some embodiments, first type connection components 116 and second type connection component 118 may respectively include female and male snap fasteners configured to mechanically connect with each other. Alternatively, first type connection components 116 may include male snap fasteners and second type connection component 118 may include a female snap fastener. In another example, band connection components 114 may include Velcro components, such as Velcro hooks and loops. In another example, connection component 114 may comprise a buckle or clasp. In some embodiments, flexible 102 may not include any band connection components. For example, end portions 108 and 110 may be securely attached with each other, such as by an adhesive, bolt, or other suitable technique. In yet another example, flexible band 102 may be formed of a continuous loop of flexible material that does not define any end portions.

One or more male interface components 112, in various lengths, size and shapes, may be disposed on outer surface 102 of flexible band 102. Each of male interface components 112 may comprise a protrusion from outer surface 102 dimensioned to be capable of insertion within a female interface component of an object to mechanically attach the object with flexible band 102. With reference to FIG. 2, some example attachable objects may include building blocks 202 and figurine 204. Objects may be attached to flexible band 102 and/or to a second object. Figurine 204, for example, is shown as being attached with a building block that is attached with flexible band 102.

In some embodiments, to support the capability of any male interface component 112 to be inserted within a female interface component of the object, each of a plurality of male interface components 112 may have a common or substantially common shape and size. As shown in FIG. 1, for example, male interface components 112 may comprise a protrusion including a cylindrical shape for insertion within a correspondingly shaped cavity of a female interface component of an object, such as a female interface component of a building block. With reference to FIG. 3, showing a top view of wearable device 100, some or all male interface components 112 may include a common cross sectional diameter D. In some embodiments, the cross sectional diameter may be 5 millimeters and/or substantially 5 millimeters.

In some embodiments, the plurality of male interface components 112 may be disposed to support flexible configurations of object attachment. For example, where the object is a building block, the building block may be a unit of a multi-unit kit or the like. Each unit of the kit may include object male interface components and/or female interface components for connection with other units. To support configurability of building block attachment, adjacent female interface components of a building block may be separated by each other by a standard distance or pitch. Accordingly, each of the plurality of male interface components 112 may be separated from each other by at least the distance defined between two adjacent female interface components of the building block. With reference to FIG. 3, for example, each male interface component 112 is separated from the other male interface components by at least distance P. In some embodiments, adjacent male interface components 112 of flexible band 102 may be separated by exactly the distance between two adjacent female interface components of the object (but in other instances they might be separated by a varying distances). For example, male interface component 304 is separated from each of adjacent male interface components 302, 306 and 308 by distance P. In some embodiments, the distance P may be 3.1 millimeters or substantially 3.1 millimeters.

In some embodiments, male interface components 112 may be arranged in one or more rows, columns, and/or grids. Each row (or column) may include one, two or more male interface components that are separated from each other (e.g., adjacent male interface components) by a common distance along the row. For example, as shown in FIG. 3, male interface components 302, 304 and 306 may be arranged in a row and separated from each other by the distance P. Similarly, male interface components 304 and 308 may also be arranged in a row and separated from each other by the distance P. With reference FIG. 4, showing a cross sectional side view of wearable device 100 taken along the line AA shown in FIG. 3, a row of adjacent male interface components may allow on object to be attached with wearable device 100 via multiple male interface components of the row. For example, object (or building block) 404, including two female interface components, may be attached with male interface components 406 and 408. Similarly, object 406, including a single female interface component, may be attached with male interface component 412.

In some embodiments, male interface components 112 may include a first row of male interface components (e.g., the row including components 302-306 shown in FIG. 3) and a second row of male interface components (e.g., the row including components 308 and 310) aligned in parallel to the first row of male interface components. Each of the first row of male interface components may be separated from each other by a common distance, such as the distance P. Similarly, each of the second row of male interface components may also be separated from each other by the common distance. Furthermore, each of the first row of male interface components may be also separated from a respective one of the second row of male interface components by the common distance, such as shown by components 304 and 308 being separated by the distance P in FIG. 3.

In some embodiments, the protrusions of male interface components 112 of wearable device 100 may have a height that is greater than a height of the male interface components of the object. For example, the height of male interface components 112 is not necessarily limited to the height of a standard male interface component of the object and may be extended up the depth of the female interface component cavity of the object. As such, more interfacing surface area between the object and male interface components 112 is possible, thereby providing a more secure attachment between the object and wearable device 100. With reference FIG. 4, for example, male interface component 406 of wearable device 100 may include a height H1 that is greater than height H2 of male interface component 414 of object 404. In some embodiments, H1 may be 8.0 mm or substantially 8 millimeters and H2 may be 1.6 millimeters or substantially 1.6 millimeters.

In some embodiments, wearable device 100 may include one or more female interface components. With reference to FIG. 3, for example, flexible band 102 may include and/or define female interface component 312. Female interface component 312 may be shaped and dimensioned to receive a male interface component of an object, such as male interface component 414 of object 404 shown in FIG. 4. In that sense, female interface component 312 may include a cavity configured to receive a protrusion defined by male interface component 414 for secure attachment. In some embodiments, the cavity of female interface component 312 may define a depth having a distance H2 that corresponds with the height of male interface component 414 of object 404. In some embodiments, female interface component 312 may be separated from each of male interface components 112 and/or other female interface components of flexible band 102 by at least a distance (e.g., P) defined between two adjacent female interface components of an object. Furthermore, in some embodiments, female interface components may be arranged within the rows, columns, or grids of interface components discussed above.

The shape and form of a wearable device, as well as the arrangements and features of male and/or female interface components on the wearable device, may be different in various embodiments. FIG. 5 shows top view of an example wearable device 500 in accordance with some embodiments. Wearable device 500 may include a flexible band 502 including outer surface 504. Outer surface 504 defines a circular surface region 506 on which interface components may be disposed, although it is appreciated that other designs for flexible band 500 may also be used. A plurality of interface components may be disposed on outer surface 504. The interface components may be arranged in rows including two or more interface components, or otherwise, while maintaining the separation of interface components by at least the standard distance P. In various embodiments, some or all of the interface components may include cross-sectional shapes other than circular shapes. For example, interface component 508 may include a square or rectangular cross sectional shape. In another example, interface component 510 may include a triangular cross sectional shape. In some embodiments, two or more interface components may additionally or alternatively include a different size. For example interface component 512 includes a larger cross sectional diameter than interface component 514. The various sizes of interface components that can be used allow a wearable device to be compatible with different objects, such as to accommodate different connector specifications of different building block sets, components, and/or manufacturers.

In some embodiments, the flexible band of a wearable device may be constructed of a flexible, semi-rigid material. For example, elastic material such as silicone rubber may be molded or cured to form the main body of the flexible band. The protrusions of male interface components, when used, may be embossed onto, raised from, grooved into, or attached to the outer surface. The female interface components, when used, may be formed within the flexible band as part of the molding process. In another example, female interface components may be etched from the flexible band subsequent to the molding or curing. In some embodiments, the male interface components may also be constructed of a flexible, semi-rigid material such as silicone rubber. Here, portions of the male interface components may be allowed to slightly flex or bend to accommodate connection with objects of various shape or size. Alternatively, the male interface components may be constructed of a more rigid material, such as a polymer or plastic. In some embodiments, the band might be formed from multiple partial bands, or units, connected as some or all of multiple unit kit.

In some embodiments, a male interface component may additionally include conductive contacts. For example and as shown in FIG. 5, wearable device 500 may include battery 516 and/or other power supply. In some embodiments, battery 516 may be disposed on the inner surface of flexible band 502 opposite outer surface 506, as indicated by battery 516 being shown in outline. The positive and negative terminals of the battery 516 may each be connected with respective conductive contacts of two or more male interface components, such as male interface components 508 and/or 512 for the positive terminal and male interface components 518 and/or 520 for the negative terminal. In some embodiments, the object may include corresponding positive and negative contacts within two (e.g., adjacent) female interface components, a positive contact within a male interface component and a negative contact within a female interface, and/or a positive contact within a female interface component and a negative contact within a male interface component The wearable device may be configured to provide power to an attached object when the object is attached with the male interface components of the wearable device. As such, objects other than building blocks may be alternatively or additionally connected with the wearable device, including electronic devices (e.g., clocks, computing devices, mobile phones, smartphones, etc.) and electromechanical devices (e.g., moving parts of a structure, vehicle, figurine, etc.).

Many modifications and other embodiments will come to mind to one skilled in the art to which these embodiments pertain having the benefit of the teachings presented in the foregoing descriptions and the associated drawings. For example, while wearable devices may include flexible band for attachment to a wrist, arm, leg, or the like, the techniques discussed herein may also be extended to other types of apparel or accessories. For example, some embodiments may provide for a shirt, pants, wallet, purse, shoes, etc. including a plurality of interface components to which objects may be attached. Therefore, it is to be understood that embodiments and implementations are not to be limited to the specific example embodiments disclosed and that modifications and other embodiments are intended to be included within the scope of the appended claims. Although specific terms are employed herein, they are used in a generic and descriptive sense only and not for purposes of limitation.

That which is claimed:

1. A wearable device, comprising:

a flexible band including an outer surface;

a plurality of male interface components disposed on the outer surface of the flexible band, wherein each of the plurality of male interface components comprises a protrusion dimensioned to be capable of insertion within a female interface component of an object to mechanically attach the object with the flexible band; and at least one female interface component disposed on the outer surface of the flexible band, wherein the female interface component is separated from each of the plurality of male interface components by at least a distance defined between two adjacent female interface components of the object.

2. The wearable device of claim 1, wherein the plurality of male interface components have a common shape and size.

3. The wearable device of claim 2, wherein the plurality of male interface components include a circular cross sectional shape having a diameter of substantially 5 millimeters.

4. The wearable device of claim 1, wherein each of the plurality of male interface components are separated from each other by at least a distance defined between two adjacent female interface components of the object.

5. The wearable device of claim 4, wherein the distance is substantially 3.1 millimeters.

6. The wearable device of claim 1, wherein the plurality of male interface components includes at least three male interface components arranged in a row and separated from each other by a common distance along the row.

7. The wearable device of claim 1, wherein the plurality of male interface components includes a first row of male interface components and a second row of male interface components aligned in parallel to the first row of male interface components;

each of the first row of male interface components are separated from each other by a common distance;

each of the second row of male interface components are separated from each other by the common distance; and each of the first row of male interface components is separated from a respective one of the second row of male interface components by the common distance.

8. The wearable device of claim 1 further comprising a band connection component configured to connect a first end portion of the flexible band with a second end portion of the flexible band.

9. The wearable device of claim 1, further comprising the object including one or more male interface components, and wherein each of the one or more male interface components of the object comprises a protrusion having a height that is less than a height of the plurality of male interface components of the wearable device.

10. The wearable device of claim 9, wherein the height of the plurality of male interface components of the wearable device is greater than 1.6 millimeters.

11. The wearable device of claim 9, wherein the object is a building block.

12. The wearable device of claim 1 further comprising a power supply including a positive terminal and a negative terminal and wherein a first of the plurality of male interface components includes a first conductive contact connected with the positive terminal and a second of the plurality of male interface components includes a second conductive contact connected with the negative terminal.

13. A wearable device, comprising:

a flexible material including an outer surface;

at least three male interface components disposed on the outer surface of the flexible material, wherein each of the at least three male interface components are separated from an adjacent male interface component by a common distance, wherein each of the at least three male interface components comprises a protrusion dimensioned to be capable of insertion within a female interface component of an object to mechanically attach the object with the flexible material; and at least one female interface component disposed on the outer surface of the flexible material, wherein the female interface component is separated from each of the at least three male interface components by at least a distance defined between two adjacent female interface components of the object.

14. The wearable device of claim 13, wherein each of the at least three male interface components have a common shape and size.

15. The wearable device of claim 14, wherein each of the at least three male interface components include a circular cross sectional shape having a diameter of substantially 5 millimeters.

16. The wearable device of claim 13, wherein the common distance is defined by a distance between two adjacent female interface components of an object capable of being attached with the wearable device via one or more of the at least three male interface components.

17. The wearable device of claim 13, wherein the common distance is substantially 3.1 millimeters.

18. The wearable device of claim 13, wherein the height of the at least three male interface components of the wearable device is greater than 1.6 millimeters.

* * * * *